US005660641A

United States Patent [19]

Howe

[11] Patent Number: 5,660,641

[45] Date of Patent: Aug. 26, 1997

[54] METHOD FOR REMOVING SOILS FROM A PAINTED AUTOMOBILE SURFACE

[75] Inventor: Michael Howe, Mission Viejo, Calif.

[73] Assignee: Armor All Products Corporation, Aliso Viejo, Calif.

[21] Appl. No.: 460,848

[22] Filed: Jun. 5, 1995

Related U.S. Application Data

[62] Division of Ser. No. 158,624, Nov. 24, 1993, Pat. No. 5,494,611.

[51] Int. Cl.[6] ..... B08B 3/04; C11D 3/18; C11D 1/83; C11D 1/14

[52] U.S. Cl. ..... 134/26; 134/38; 134/40; 510/241; 510/242; 510/433; 510/501; 510/505

[58] Field of Search ..... 134/26, 38, 39, 134/40; 252/548, 162, 153, 166; 510/241, 242, 433, 501, 505

[56] References Cited

U.S. PATENT DOCUMENTS

| | | | |
|---|---|---|---|
| 4,414,128 | 11/1983 | Goffinet | 252/111 |
| 4,511,488 | 4/1985 | Matta | 252/162 |
| 4,533,487 | 8/1985 | Jones | 252/170 |
| 4,704,225 | 11/1987 | Stoufer | 252/153 |
| 4,772,426 | 9/1988 | Koch et al. | 252/549 |
| 4,976,885 | 12/1990 | Wisotzki et al. | 252/174.17 |
| 5,043,091 | 8/1991 | Joshi et al. | 252/174.17 |
| 5,104,567 | 4/1992 | Staehr | 252/174.17 |
| 5,118,440 | 6/1992 | Cutler et al. | 252/174.17 |
| 5,143,639 | 9/1992 | Krawack | 252/162 |
| 5,146,938 | 9/1992 | Lutener et al. | 134/40 X |
| 5,194,173 | 3/1993 | Folkard et al. | 134/40 X |
| 5,204,016 | 4/1993 | Hamilton et al. | 252/162 |
| 5,213,624 | 5/1993 | Williams | 134/40 X |
| 5,271,773 | 12/1993 | Hamilton et al. | 134/10 |
| 5,277,836 | 1/1994 | Peters | 252/143 |
| 5,281,354 | 1/1994 | Faber | 252/154 |
| 5,340,493 | 8/1994 | Principato | 252/462 |

*Primary Examiner*—Jill Warden
*Assistant Examiner*—Saeed Chaudhry
*Attorney, Agent, or Firm*—Flehr Hohbach Test Albritton Herbert, LLP

[57] ABSTRACT

The specification discloses compositions and methods for removing particulate and greasy soils from painted and waxed surfaces without stripping the paint or wax. The composition comprises terpene and a surfactant. When applied to a surface as a concentrate, the composition effectively removes greasy and oily soils such as tree sap, tar, and other soils of this type which are typically difficult to solubilize using standard detergents. The composition can be diluted with cold water and applied to a surface to remove particulate soils. The composition and method are particularly useful for cleaning greasy and particulate soils from automotive surfaces.

18 Claims, No Drawings

METHOD FOR REMOVING SOILS FROM A PAINTED AUTOMOBILE SURFACE

This application is a division application of U.S. patent application Ser. No. 08/158,624, filed Nov. 24, 1993, now U.S. Pat. No. 5,494,611.

FIELD OF THE INVENTION

This invention relates to a dual-purpose cleaning composition suitable for use on painted and waxed surfaces, and in particular, suitable as a car wash and bug and tar remover.

BACKGROUND OF THE INVENTION

Many different types of automobile cleaning agents are available for different cleaning purposes. The compositions of the various cleaning agents are adapted for use on the particular automobile surface to be cleaned and the type of soil to be removed. For example, petroleum distillates are commonly used to clean brake dust and road grime from wheels. Vinyl and rubber surfaces can be cleaned and preserved with polysiloxane-containing compositions, as described in U.S. Pat. No. 3,956,174. Car wash compositions typically comprise anionic detergents. The active ingredients of bug and tar removal compositions are typically petroleum distillates, xylene, benzene, or other hydrocarbon solvents.

From a consumer perspective, a multi-purpose cleaner would be desirable to reduce costs and save time by combining automotive cleaning tasks. However, typical car washes are not capable of removing bugs, tar, tree-sap, and other greasy substances from auto body surfaces. There is currently no product capable of combining the functions of a car wash product with that of a bug and tar remover product.

In an era where health and environmental concerns are increasing, it is becoming more desirable to use effective cleaning compositions that are non-caustic and environmentally safe. Therefore, it is desirable to clean greasy substances without petroleum derived or halogenated hydrocarbon solvents or high levels of caustic and/or phosphates.

Various non-caustic and environmentally safe components of cleaning agents have been demonstrated to be capable of removing greasy and oily soils from a variety of surfaces to be cleaned. For example, a non-caustic cleaner is described in U.S. Pat. No. 4,511,488 which comprises d-limonene. The cleaning compositions is effective for industrial cleaning tasks, such as those in machine shops, automotive service centers, food processing industries, where oily and particulate soils accumulate.

U.S. Pat. No. 4,535,487 also describes a non-caustic cleaning composition containing d-limonene in combination with a liquid detergent. The cleaning composition is effective in removing tar, grease, wax, rust, paint, and other soils.

U.S. Pat. No. 5,204,016 describes a non-caustic oven cleaner containing d-limonene.

U.S. Pat. No. 4,180,472 discloses the use of fatty acid alkyl esters in cleaning compositions for the removal of oily soils from fabrics.

U.S. Pat. No. 5,143,639 describes the use of fatty acid alkyl esters for removing fat, inks and the like from printing apparatus.

Thus, terpenes and fatty acid alkyl esters have been demonstrated to be effective grease and dirt-removing alternatives to hydrocarbon solvents. However, none of the above-mentioned references discloses a cleaning composition which has the desirable foaming, rinsing, and drying properties of a car wash and remains an effective degreaser in cold water without stripping wax or paint from the surface to be cleaned.

SUMMARY OF THE INVENTION

Given the foregoing inefficiencies attendant with the prior art of cleaning compositions for particulate and greasy soils, it is an object of the present invention to provide a cleaning composition, suitable for use on painted and waxed surfaces such as auto bodies, that is capable of retaining the foaming and cleaning properties of a car wash yet is capable of removing greasy substances with cold water.

It is a further object of the present invention to provide such a cleaning composition without the use of dangerous hydrocarbon solvents.

These and other objects and features of the present invention will be apparent to those skilled in the art from the following detailed description and appended claims.

The foregoing objectives are achieved by the cleaning compositions described herein which are safe to use on painted and waxed surfaces, such as auto body surfaces. The cleaning compositions foam sufficiently and effectively remove grease and particulate soils when diluted with cold water. In one embodiment, the cleaning composition comprises from about 5 to about 25 weight percent of an anionic and/or nonionic surfactant, and 2 to 8 weight percent of at least one terpene. In another embodiment, the cleaning composition comprises from about 5 to about 25 weight percent of an anionic and/or nonionic surfactant, and 2 to 8 weight percent of at least one fatty acid alkyl ester of the formula:

$$R_1-\overset{\overset{\displaystyle O}{\|}}{C}-O-R_2$$

wherein $R_1$ is an alkyl group having from about 6 to about 18 carbons, and $R_2$ is an alkyl group having from 1 to about 5 carbon atoms.

DETAILED DESCRIPTION OF THE INVENTION

Typically, the properties desired of a cleaning composition for painted and waxed surfaces, and in particular auto body surfaces, are foaming, cleaning of particulate soils, rinsibility, and drying capabilities. For user convenience, it is preferable that these properties be retained by the cleaning composition when used with cold water. The cleaning compositions of the present invention achieve these properties and have the added benefit of effectively removing greasy soils in addition to particulate soils without stripping wax or paint from the surface. These cleaning compositions are able to sufficiently foam upon dilution in cold water.

As used herein, the term "greasy soils" refers to organic and oily soils such as tree sap, tar, and other soils of this type which are typically difficult to solubilize using standard detergents. With prior art methods of cleaning autobody surfaces, greasy soils are usually removed with a hydrocarbon solvent. The term "particulate soils" refers to dirt and other soils which are typically solubilized and removed with detergent compositions containing anionic and nonionic surfactants. A dual-purpose cleaning composition for removing both greasy and particulate soils from auto body surfaces cannot be attained by merely adding a hydrocarbon solvent to a car wash composition containing surfactants. Such a combination results in a composition having decreased foaming and cleaning capabilities and minimal grease cleaning capability.

The present invention utilizes terpenes and/or fatty acid alkyl esters as effective grease cleaning agents in cleaning compositions which also comprise anionic and/or nonionic surfactants. The resulting cleaning composition effectively cleans greasy soils and maintains sufficient foaming and particulate soil cleaning capabilities.

The terpene component is used to solubilize greasy soils. Terpenes are Hydrocarbons in essential oils, resins, and other vegetable aromatic products which can act as solvents and dispersing agents. Particularly suitable terpenes include cyclic terpenes such as limonene, dipentene, terpinene, and other monocyclic and bicyclic terpenes. They are used in an aqueous anionic and/or nonionic surfactant formulation preferably in amounts of about 2 to 8 weight percent, and more preferably at about 4 weight percent. At amounts less than about 2 weight percent, the composition may not effectively remove tar and grease. At amounts greater than about 8 weight percent excellent cleaning, tar and grease removal, rinsing, and drying is achieved; however, foaming properties may be compromised, and the composition may strip wax.

Fatty acid alkyl esters are also very useful for the removal of heavy oil soils such as tar and motor oil and can be used in addition to or in place of the terpene in the cleaning compositions. Suitable fatty acid alkyl esters have the formula:

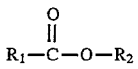

wherein $R_1$ is an alkyl group, saturated or unsaturated, having from about 6 to 18 carbons; and $R_2$ is an alkyl group having from 1 to about 5 carbon atoms. When $R_1$ is unsaturated, it preferably has no more than 2 sites of unsaturation. Generally the longer the $R_1$ chain, the more effective the component is in removing grease and tar. However, it is desirable to have fatty acid alkyl esters having a distribution of chain lengths for an overall more effective cleaner. This is because the shorter chains (e.g. $C_8$) have better solubility due to higher charge to chain length ratio. They work to solubilize the longer chains as well as some of the oily soil. The longer chains (e.g. $C_{16}$ or $C_{18}$) have relatively greater oil solubility/affinity due to the longer fatty tail. Thus a distribution of chain lengths is preferred. Suitable fatty acid methyl esters include oleic acid methyl ester, coco fatty acid methyl ester, lauryl fatty acid methyl ester, and the like. The fatty acid alkyl esters are preferably used in amounts of about 2 to 8 weight percent. At amounts less than 2 weight percent removal of oily and greasy soils is less effective. At greater than about 8 weight percent, either foaming is reduced and/or the solubilization of the component in the cleaning composition is more difficult and rinsibility is not as good. However, levels of fatty acid alkyl esters greater than 8 weight percent does increase tar and heavy grease removal.

The cleaning composition also comprises a surfactant. While very high amounts of surfactant can be used—up to about 92% of the total composition—cost becomes a significant factor when surfactants are used in amounts of above 60%. Additionally, very high surfactant levels tend to reduce the tar/grease removal ability of the other ingredients, thus eliminating the dual benefit of the cleaning compositions of the present invention. High levels of surfactants also effect the rinsibility resulting in residual films or requiring more vigorous rinsing. Accordingly, it is preferred that the cleaning composition comprise surfactant in amounts of about 5 to about 25 weight percent surfactant. The cleaning composition can be prepared as a concentrate wherein enough water is used to dissolve the components. With a concentrated solution, the ratio of terpene and/or fatty acid alkyl ester to surfactant will be from about 1 part terpene and/or fatty acid alkyl ester to 12.5 parts surfactant to about 2 parts terpene and/or fatty acid alkyl ester to 1 part surfactant. As used herein, the term surfactant refers to both nonionic and anionic surfactants and combinations thereof. One or more anionic surfactant provides the cleaning of particulate and ionic soils and also provides the foaming action of the cleaning composition. Various anionic surfactants are known in the art and will find use in the present invention. For example, suitable anionic surfactants include alkylbenzenesulfonate, lauryl sulfate sodium salt, ether sulfate sodium salt, alpha-olefin sulfonate sodium salt, alcohol ether sulfate ammonium salt, and the like.

While anionic surfactants are excellent for cleaning particulate and ionic soils, they are less effective against oily soils. Nonionic surfactants are more effective at removing oily soils. Nonionic surfactants will also clean particulate and ionic soils, but less effectively than the anionics. It has been found that while each type of surfactant can be used alone in the cleaning composition, more effective cleaning can be achieved by using blends of the two. Thus, a particularly effective cleaning composition comprises both anionics and nonionics. The blend ratio varies depending on the nature of the soil to be cleaned. Cleaning compositions that will be used primarily on oily soils will require higher concentrations of nonionics in order to be more effective. Conversely, soils that are high in particulates and ionic soils are more effectively cleaned with compositions comprising higher concentrations of anionics. For cleaning the types of soils typically found on the painted and waxed surfaces of automobiles, a suitable cleaning composition will have from about 2 to about 20 weight percent of at least one anionic surfactant, and from about 1 to about 10 weight percent of a nonionic surfactant. More preferably, the cleaning composition will comprise about 8 to about 15 weight percent of at least one anionic surfactant, and from about 1 to about 5 weight percent of a nonionic surfactant. A preferred concentrated solution has a ratio of terpene or fatty acid alkyl ester to anionic surfactant to nonionic surfactant of about 1 part terpene and/or fatty acid alkyl ester to 2 parts anionic surfactant to 1 part nonionic surfactant.

Various nonionic surfactants are well known in the art and will find use in the present invention. For example, suitable nonionic surfactants include coconut diethanolamide; amine oxides such as coco aminopropyl dimethyl amine oxide, cetyl dimethylamine oxide, lauryl dimethylamine oxide, myristyl cetyl dimethylamine oxide, and the like; nonyl phenol ethoxylate; ethoxylated alcohols such as polyoxyethylene-2-oleyl ether, polyoxyethylene-10-oleyl ether, and the like; ethoxylate propoxylated block co-polymers; and the like. Nonionic amides are particularly useful because they are more soluble and free rinsing than typical nonionics. Typical nonionics tend to lose solubility in cold water and deposit on the surface that is cleaned, thus leaving a film which is difficult to rinse off. The nonionic amides also have better foaming properties than typical nonionics. The nonionic surfactant(s) is used in amounts ranging from about 1 to about 10 weight percent.

In addition to the above mentioned components, the cleaning compositions of the present invention can include other suitable additives depending upon the intended use of the composition. For example, thickening agents, such as polyacrylic acids, clay, xanthene gums, alginates, other natural gums, and the like, may be added. The purpose of these materials is to enhance the viscosity and thereby provide better cling of the cleaning composition. Cling, anti-sag, or viscosity allows the cleaning composition to stay in contact with the soiled surface, thereby enhancing its effectiveness. Additionally, these cleaning compositions may be thickened by the addition of sodium chloride, sodium sulfate, or the like. Other materials for use as coupling agents may also be incorporated into the composition in appropriate amounts. Suitable coupling agents include sodium xylene sulfate (SXS), sodium naphthalene sulfate, mono and di-phosphate esters, and the like. The coupling agents can positively effect the detergency of the cleaning composition.

Glycol ethers can be used in amounts of about 1 to about 10 weight percent in combination with the terpene or fatty acid alkyl ester. The glycol ethers enhance the cleaning of the formula through the additional solubilization of oily and slightly charged soils. Glycol ethers also assist in the solubilization of the fatty acid methyl esters. Suitable glycol ethers are propylene glycol ethers such as propylene glycol n-butyl ether, propylene glycol T-butyl ether, propylene glycol n-propyl ether, and the like. Ethylene glycol ethers can also be used such as ethylene glycol monobutyl ether, diethylene glycol mono butyl ether, ethylene glycol phenylether, and the like.

To remove bugs, tar, and tree sap from automobile surfaces the cleaning composition is generally used in its concentrated form. The composition is dabbed directly on the soiled surface and allowed to contact the surface from about 3 to 5 minutes depending on the amount of soil. The surface can then either be rinsed with water or removed with a cloth, or the entire surface can be washed with the composition diluted in water. The cleaning composition can be diluted at a ratio of about 1 part cleaning composition to about 25 to about 200 parts water. Preferably, about one to two ounces of the cleaning composition is diluted with about 1 gallon of water (128 ounces). Generally the water is added with sufficient force (e.g. from a garden hose) to allow sufficient sudsing. The automobile surface is washed in the normal manner of dipping a sponge, cloth or the like into the diluted cleaning composition and applying it to the car surface. The wiping motion with the sponge serves to lift, solubilize, and suspend the soils. When washing over prespotted areas, no more than the normal washing motion is needed to remove the bugs, tar and tree sap which has been pretreated.

The advantages of the cleaning composition of the present invention is that upon dilution with water, it has highly stable foam and exhibits excellent cleaning and rinsing characteristics. Prior to the present invention, there were no cleaning compositions, and in particular no automobile cleaning compositions, that exhibited the above characteristics that additionally were effective at removing bugs, tar and tree sap from surfaces. The prior art automobile wash compositions do nothing to lift and solubilize such soils, and many when administered undiluted will strip the automobile of its protective wax layer.

In order that the invention described herein may be more fully understood, the following examples are set forth. It should be understood that these examples are for illustrative purposes only and are not to be construed as limiting the scope of the invention in any manner.

EXAMPLE 1

Preparation of Cleaning Composition Having Fatty Acid Alkl Ester Degreasing Agent A typical formulation of a cleaning composition having a fatty acid alkyl ester degreasing agent is as follows:

| Ingredient | Amount (% by wt.) |
|---|---|
| Water | q.s |
| Disodium dicarboxylic coco derivative | 2.0 |
| Sodium linear alkyl benzene sulfonate | 6.0 |
| Sodium dodecyl diphenyl oxide disulfonate | 1.0 |
| Oleic diethanol amide | 2.0 |
| $C_8$—$C_{16}$ alkyl polyglycoside | 5.0 |
| Coco fatty acid methyl ester | 5.0 |
| Propylene glycol n-butyl ether | 2.0 |
| Hexapotassium hexamethylene diamine tetra (methylene phosphonate) | 1.0 |
| Tetra sodium EDTA | 0.50 |
| Sodium chloride | 0.50 |

The selected anionic or combination of anionics is added to the fatty acid methyl ester and mixed slowly to avoid incorporating air, thus keeping the solution clear. The water is added followed by the addition of the nonionics and/or nonionic amides. Mixing is continued until the composition is uniform. At this point, the glycol ether is added followed by the other additives such as sequestering agents, freeze-thaw stabilizers, thickeners, salts, color, perfume and the like.

EXAMPLE 2

Preparation of Cleaning Composition Having a Terpene Degreasing Agent

A typical formulation of a cleaning composition having a terpene degreasing agent is as follows:

| Ingredient | Amount (% by wt.) |
|---|---|
| Water | q.s |
| Sodium linear alkyl benzene sulfonate | 8.0 |
| Sodium ether sulfate | 4.0 |
| Alpha olefin sulfonate sodium salt | 4.0 |
| Myristyl dimethyl amine oxide | 2.0 |
| d-limonene | 4.0 |
| Propylene glycol n-butyl ether | 4.0 |
| Sodium EDTA | 0.50 |
| Sodium Chloride | 0.75 |
| Glycerine | 0.50 |

The ingredients are combined using the same methods as described in Example 1.

EXAMPLE 3

Foaming, Cleaning, Tar Removal, Rinsibility, and Drying Characteristics of Various Cleaning Compositions Various cleaning compositions were prepared following the general procedure described in Example 1. The ability of each cleaning composition to effectively foam, clean particulate soils, remove tar, rinse, and dry was ranked on a scale of 1 to 5, with 1 being excellent, 3 good, and 5 poor. Table I lists the weight percent of the active ingredients of five of the cleaning compositions (A–E) as well as the components of a typical car wash (control). The table also lists the rating values of each composition on the various properties tested.

TABLE I

| Ingredients | A | B | C | D | E | Control |
|---|---|---|---|---|---|---|
| Anionic sulfonate | 13 | 16 | 16 | 9 | 16 | 16.5 |
| Nonionic amides | 2 | 2 | — | 2 | 2 | 2 |
| Nonionic | — | — | 2 | 5 | — | 1 |
| d-Limonene | 4 | 8 | 4 | — | 4 | — |
| Fatty acid methyl ester | — | — | — | 5 | 4 | — |
| Propylene glycol ether | — | — | 4 | 2 | — | — |
| Water | q.s to 100% | | | | | |
| RATINGS | | | | | | |
| Foaming | 1 | 2 | 2 | 3 | 3.5 | 4 |
| Cleaning | 1 | 2 | 1 | 1 | 3 | 3 |
| Tar removal | 1 | 1 | 1 | 1 | 2 | 5 |
| Rinsibility | 1 | 3 | 2 | 3 | 3 | 2 |
| Drying | 1 | 3 | 2 | 2 | 4 | 3 |

As can be seen from Table I, the cleaning and tar removal properties of cleaning compositions containing a fatty acid alkyl ester and/or a terpene are superior to compositions comprising only surfactants as active ingredients.

What is claimed is:

1. A method of removing soils from a painted automobile surface comprising applying an aqueous cleaning composition to said surface to solubilize said soils and removing said solubilized soils from said surface, wherein said composition comprises at least one terpene in an amount of from about 2 to 8 weight percent, at least one nonionic amide surfactant, and at least one anionic surfactant, wherein the ratio of terpene to total surfactant is about 1:12.5 to about 2:1.

2. The method of claim 1 wherein said soils comprise greasy soils and wherein said aqueous cleaning composition is applied to said greasy soils.

3. The method of claim 2 wherein said painted automobile surface is waxed and wherein paint and wax on said surface are not stripped by said aqueous cleaning composition.

4. The method of claim 2 wherein said soils additionally comprise particulate soils, and said method comprises the additional step of diluting a portion of said cleaning composition with water at a ratio of from about 1 part cleaning composition to about 25 to about 200 parts water, applying said diluted cleaning composition to said surface to solubilize said particulate soils, and rinsing said surface with water.

5. The method of claim 4 wherein said water, with which said portion of said cleaning composition is diluted, is cold.

6. The method of claim 4 wherein said painted automobile surface is waxed and wherein paint and wax on said surface are not stripped by said aqueous cleaning composition.

7. The method of claim 1, wherein prior to applying said aqueous cleaning composition to said surface, said cleaning composition is diluted with water at a ratio of from about 1 part cleaning composition to about 25 to about 200 parts water and wherein said solubilized soils are removed by rinsing said surface with water.

8. The method of claim 7 wherein said water, with which said cleaning composition is diluted, is cold.

9. The method of claim 7 wherein said painted automobile surface is waxed and wherein paint and wax on said surface are not stripped by said aqueous cleaning composition.

10. A method of removing soils from a painted automobile surface comprising applying an aqueous cleaning composition to said surface to solubilize said soils and removing said solubilized soils from said surface, wherein said composition comprises at least one fatty acid alkyl ester in an amount of from about 2 to about 8 weight percent having the formula:

$$R_1-\overset{\overset{\displaystyle O}{\|}}{C}-O-R_2$$

wherein $R_1$ is an alkyl group having from about 6 to about 18 carbons, and $R_2$ is an alkyl group having from 1 to about 5 carbon atoms, at least one nonionic amide surfactant, and at least one anionic surfactant, wherein the ratio of fatty acid alkyl ester to total surfactant is about 1:12.5 to about 2:1.

11. The method claim 10 wherein said soils comprise greasy soils and wherein said aqueous cleaning composition is applied to said greasy soils.

12. The method of claim 11 wherein said painted automobile surface is waxed and wherein paint and wax on said surface are not stripped by said aqueous cleaning composition.

13. The method of claim 11 wherein said soils additionally comprise particulate soils, and said method comprises the additional step of diluting a portion of said cleaning composition with water at a ratio of from about 1 part cleaning composition to about 25 to about 200 parts water, applying said diluted cleaning composition to said surface to solubilize said particulate soils, and rinsing said surface with water.

14. The method of claim 13 wherein said water, with which said portion of said cleaning composition is diluted, is cold.

15. The method of claim 13 wherein said painted automobile surface is waxed and wherein paint and wax on said surface are not stripped by said aqueous cleaning composition.

16. The method of claim 10, wherein prior to applying said aqueous cleaning composition to said surface, said cleaning composition is diluted with water at a ratio of from about 1 part cleaning composition to about 25 to about 200 parts water wherein said solubilized soils are removed by rinsing said surface with water.

17. The method of claim 16 wherein said water, with which said cleaning composition is diluted, is cold.

18. The method of claim 16 wherein said painted automobile surface is waxed and wherein paint and wax on said surface are not stripped by said aqueous cleaning composition.

* * * * *